US009963205B2

(12) United States Patent
Bauduin et al.

(10) Patent No.: US 9,963,205 B2
(45) Date of Patent: May 8, 2018

(54) DISCONNECTABLE SUBMERGED BUOY MOORING DEVICE COMPRISING CLAMPING DOGS

(71) Applicant: SINGLE BUOY MOORINGS INC., Marly (CH)

(72) Inventors: Christian Raymond Bauduin, Eze (FR); Jean-Yves Silvain Toggiani, Roquebrune Cap Martin (FR); Jean Pierre Benoit, Cagnes sur Mer (FR); Jerome Perrin, Biot (FR)

(73) Assignee: SINGLE BUOY MOORINGS INC., Marly (CH)

( * ) Notice: Subject to any disclaimer, the term of this patent is extended or adjusted under 35 U.S.C. 154(b) by 0 days. days.

(21) Appl. No.: 14/904,619

(22) PCT Filed: Jul. 12, 2013

(86) PCT No.: PCT/EP2013/064835
§ 371 (c)(1),
(2) Date: Jan. 12, 2016

(87) PCT Pub. No.: WO2015/003754
PCT Pub. Date: Jan. 15, 2015

(65) Prior Publication Data

US 2016/0185428 A1 Jun. 30, 2016

(51) Int. Cl.
*B63B 22/02* (2006.01)
*B63B 21/50* (2006.01)
*B63B 35/44* (2006.01)

(52) U.S. Cl.
CPC ..... *B63B 22/021* (2013.01); *B63B 21/508* (2013.01); *B63B 35/44* (2013.01); *B63B 2022/028* (2013.01); *B63B 2035/448* (2013.01)

(58) Field of Classification Search
CPC ..... B63B 2022/028; B63B 22/021; B63B 22/023
See application file for complete search history.

(56) References Cited

U.S. PATENT DOCUMENTS 3,637,044 A * 1/1972 Eitel ..... B66F 11/046 182/141
4,892,495 A * 1/1990 Svensen ..... B63B 21/508 114/230.12
2007/0202758 A1 8/2007 Olsen et al.

FOREIGN PATENT DOCUMENTS

WO 93/11030 A1 6/1993
WO 93/11035 A1 6/1993
(Continued)

OTHER PUBLICATIONS

International Search Report, dated Mar. 18, 2014, from corresponding PCT Application.

*Primary Examiner* — Andrew Polay
(74) *Attorney, Agent, or Firm* — Young & Thompson

(57) ABSTRACT

A mooring assembly includes: a mooring buoy having a central axis, an upper ring portion providing an upper abutment surface; a mooring structure including a cavity with a wall receiving the mooring buoy; and a buoy locking system near the cavity engaging with the upper ring portion for locking the mooring buoy to the turret mooring structure and including at least two locking devices attached to the mooring structure, each locking device having a locking dog connected to a force member for axial displacement and exerting an upward force on the upper abutment surface. The mooring buoy includes a lower abutment surface. The locking system includes an engagement member below the locking dog, engaging with the lower abutment surface and exerting a downward force. The buoy at positions axially
(Continued)

above the upper abutment surface situated at an axial clearance from the cavity wall.

12 Claims, 7 Drawing Sheets

(56) References Cited

FOREIGN PATENT DOCUMENTS

| | | | |
|---|---|---|---|
| WO | 93/24731 | A1 | 12/1993 |
| WO | 01/89919 | A1 | 11/2001 |
| WO | 2010/081826 | A1 | 7/2010 |

* cited by examiner

DISCONNECTABLE SUBMERGED BUOY MOORING DEVICE COMPRISING CLAMPING DOGS

FIELD OF THE INVENTION

This invention relates to a mooring assembly comprising:

a mooring buoy having a central axis, an upper ring portion providing an upper abutment surface, a mooring structure comprising a cavity with a cavity wall arranged for receiving the mooring buoy, and a buoy locking system arranged near the cavity for engaging with the upper ring portion for locking the mooring buoy to the turret mooring structure and comprising at least two locking devices attached to the mooring structure, each locking device having a locking dog connected to a force member for axial displacement and exertion of an upward force on the upper abutment surface.

The invention also relates to a locking device, to a structure, such as a pre-assembled turret, and to a vessel comprising a mooring structure and a buoy locking system according to the invention.

BACKGROUND OF THE INVENTION

Turret mooring assemblies are known on hydrocarbon production and/or processing vessels and comprise a mooring buoy and a turret mooring structure. The mooring buoy is anchored to the seabed with anchoring legs. The turret mooring structure, provided on a vessel, has a cavity for receiving the mooring buoy and one or more buoy locking devices for locking the mooring buoy in the cavity.

The turret mooring structure may be an internal turret mooring structure or an external turret mooring structure. An internal turret mooring structure is provided within the hull of the vessel, in a so-called moon pool. The cavity is formed as an opening at or near the bottom of the vessel, facing downwards. An external turret mooring structure is provided outside the hull of the vessel. The external turret is fixed with suitable connection members at an outboard position at the bow or stern of the vessel.

The mooring buoy may be moved up and down, i.e. from a storage position at a safe distance below the water surface (e.g. 30-200 meters) to a mooring position close to or at the surface of the water where it can be received by the cavity.

The turret mooring structure itself is connected to the vessel, but is rotatable with respect to the vessel, allowing the vessel to weathervane under influence of wind, waves, currents and drifting ice. The turret mooring system may be disconnected and reconnected when needed, thereby providing a disconnectable turret mooring system.

The turret mooring system comprises a fluid transfer system to allow transportation of hydrocarbons, such as oil or gas, for instance by establishing a flow path between the vessel and a subsea well via the turret mooring system and the mooring buoy.

The turret mooring structure may comprise a first part of the fluid transfer system and the mooring buoy may comprise a second part of the fluid transfer system. The turret mooring structure may comprise a turret manifold and the mooring buoy may comprise a buoy manifold, both manifolds each comprising at least one conduit. The turret and buoy manifold are matching such that conduits of the turret manifold can be connected to corresponding conduits of the buoy manifold of the fluid transfer system to establish a flow path.

During the connection of the mooring buoy to the turret mooring structure, the mooring buoy is locked in a fixed position with respect to the turret mooring structure inside the cavity.

According to state of the art in turret mooring systems, centering of the mooring boy in relation to the turret is carried out while locking the mooring buoy into the cavity of the turret mooring structure.

International patent applications WO1993011030-WO1993011035 disclose locking mechanisms of a turret mooring structure comprising a plurality of locking fingers distributed around an annular locking shoulder of the buoy, for releasable locking of the outer member of the mooring buoy in the receiving space. The mechanism comprises a pair of locking dogs which are actuated by a hydraulic system and are rotatable about horizontal axes at diametrically opposite sides of the receiving space. If desired, more than two locking dogs may be provided. The hydraulic actuators for operation of the locking dogs may for example be hydraulic cylinders. When activating the locking dogs these will pivot in a vertical plane to engagement with the downwards facing abutment edge of the upper cone member.

International patent application WO2001089919 discloses a mechanism for releasably locking of an element in relation to a base, especially for the locking of a buoy in a downwardly open receiving space in a floating vessel. The mechanism comprises a rotatably mounted locking arm which is pivotable between a release position and a locking position in which an abutment edge on the locking arm is in engagement with an abutment edge on the element to be locked, a linkage which is connected between the locking arm and the base and which, in the locking position, is in a self-locking over-centre position, and a driving means for actuation of the linkage. The linkage comprises a length-adjustable first link which, from an initial position with the locking arm close to its locking position, is arranged to be extended to thereby pivot the locking arm additionally to a final locking position, for achieving a desired preloading force in the engagement between the abutment edges of the locking arm and the element. The first link preferably is a hydraulic cylinder having a piston rod of which one end is connected to the locking arm.

From WO 2010/081826 a turret mooring assembly according to the preamble of claim 1 is known. The upper rim portion of the known riser supporting buoy is engaged by a number of hydraulically actuated locking members, that exert an upward force on the buoy. The upper rim portion of the known buoy is clamped in an upward direction against an abutment ring of the receiving cavity. The upper rim portion of the buoy is very stiff and loads on the buoy are al transferred into the turret via the locking members. Cyclic loading of the locking members can lead to reduced fatigue life and malfunctioning of the locking members. Furthermore, in the known locking structure the deflections between the upper part of the buoy and the receiving cavity may be relatively large, resulting in difficulties in applying a water-tight seal between the top of the buoy and the cavity wall.

It is therefore an object of the present invention to provide a mooring system that overcomes one or more of the disadvantages from the prior art. It is in particular an object of the invention to provide a mooring system in which the loads on the locking device are reduced.

It is again an object of the invention to provide a mooring system that allows effectively applying a water-tight seal between the buoy and the cavity wall.

SUMMARY OF THE INVENTION

Hereto, the mooring system according to the invention is characterized in that:

- the mooring buoy comprises a lower abutment surface placed at an axial distance below the upper abutment surface,
- the locking system comprises an engagement member situated axially below the locking dog, for engaging with the lower abutment surface and exerting a downward force thereon,
- the buoy being at positions axially above the upper abutment surface situated at an axial clearance (D) from the cavity wall such that axial forces on the buoy are transferred to the turret mooring structure substantially only at the positions of the locking dog and the engagement member.

Because the buoy—in particular the upper ring portion of the buoy—according to the invention is pulled against the engagement member, an elastic preloading of the buoy is achieved and a relatively long load path is established. When downward forces on the buoy increase, these increased forces have the effect of first reducing the preload contact between the buoy and the engagement member, only a smaller portion of the added load being taken up by the locking dog. This means that internal portions of the locking system are subject to reduced fatigue load amplitudes. The varying preload force between the locking system and the buoy does not significantly contribute to fatigue effects on the buoy or on the locking system.

In an embodiment of a mooring assembly according to the invention, the engagement member comprises a horizontal ring-shaped surface having a ring-shaped sealing member thereon for preventing ingress of water along the space between the lower abutment surface and the engagement member.

The decreasing preloading on the engagement member results in the engagement member remaining in contact with the lower abutment surface of the buoy so that the seal effectively operates under static seal conditions which can be easily maintained. Also under very heavy vertical loads, the separation of the lower abutment surface of the buoy and the engagement member on the turret will not be more than a few mm, which gap can be bridged by elastic expansion of the seal.

The ring-shaped surface can be situated at a larger radial distance from the central axis than the locking dog, such that a stepped construction is formed on which the annular seal can be accommodated.

The locking dog may be rotatable around a horizontal shaft, the force member comprising an axially movable hydraulic jack. Each hydraulic jack may be connected to a high pressure unit, such as an accumulator or pressure pump that is of compact size to power a single locking device in a standalone manner, independently from the other locking devices. The high pressure unit may be used as a backup for providing rapid disconnection of the locking devices in case of an emergency.

In a preferred embodiment, the high pressure unit of each locking device is mounted on the hydraulic jack of each respective hydraulic power unit for following pivoting movements of the hydraulic jack. In this manner no flexible hoses need be applied for supplying high pressure fluid during expansion and contraction of the piston rod of the hydraulic jack.

BRIEF DESCRIPTION OF THE DRAWINGS

Embodiments will now be described, by way of example only, with reference to the accompanying schematic drawings in which corresponding reference symbols indicate corresponding parts, and in which.

DETAILED DESCRIPTION

Figure 1A:
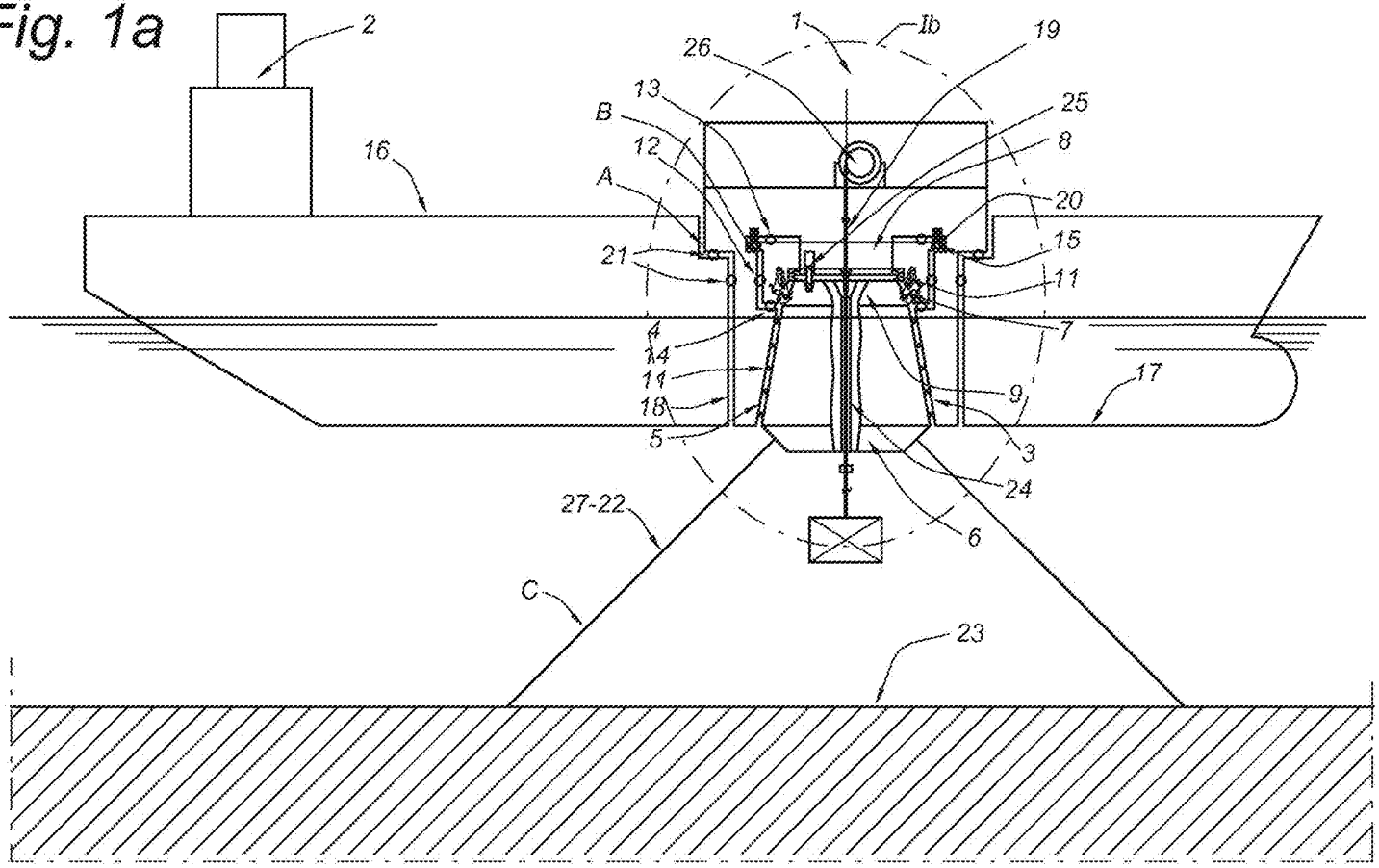
FIG. 1*a* shows a schematic drawing of a turret mooring system provided on a vessel.

In the following figures, the same reference numerals refer to similar or identical components in each of the figures.

Figure 1B:
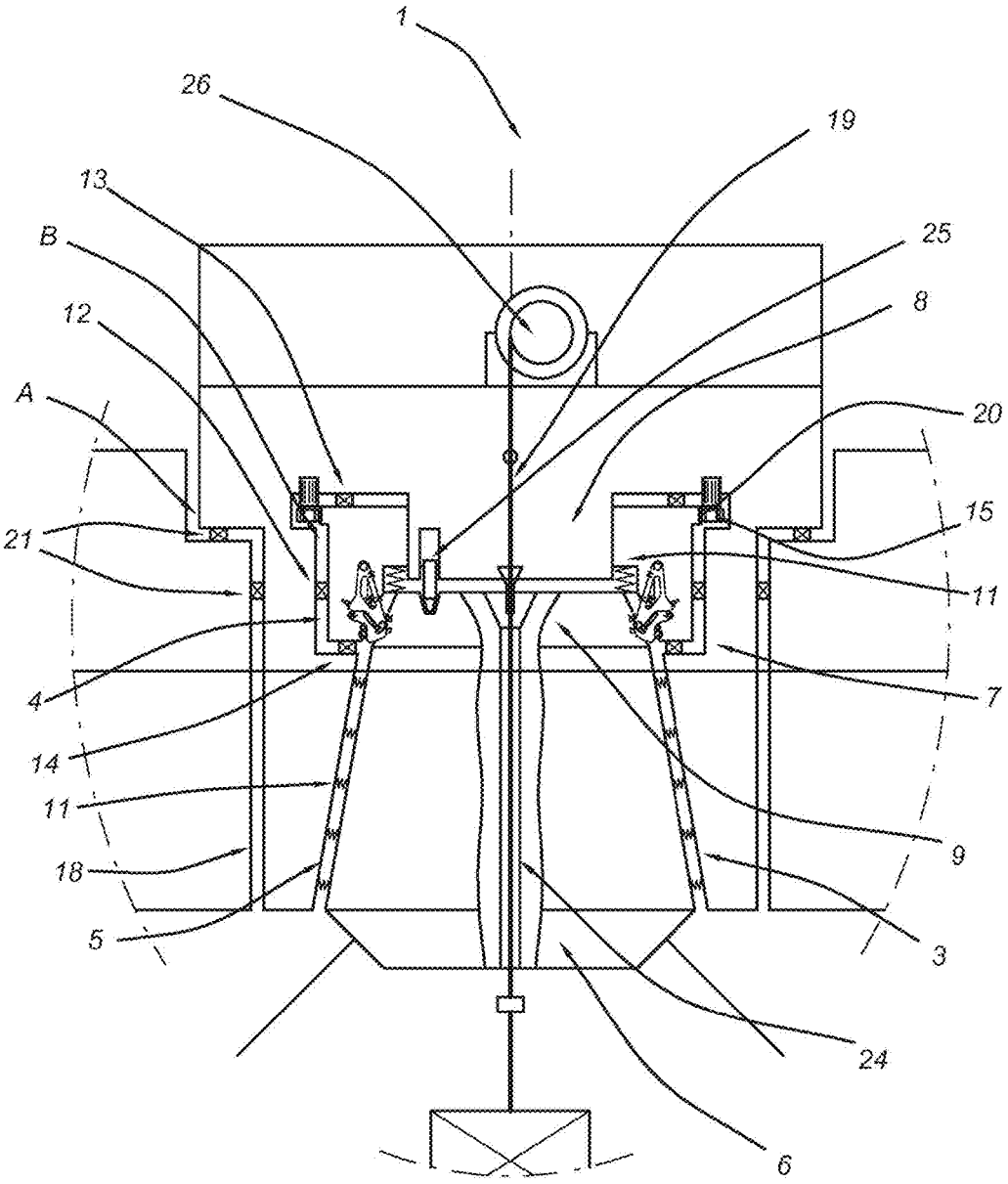
FIG. 1*b* shows an enlargement of the selected box in FIG. 1A.

FIGS. 1*a*-1*b* show schematic drawings of a turret mooring system 1 provided on a vessel 2, which for example could be a floating production unit (FPU) or floating production storage and offloading (FPSO) unit or floating storage and offloading (FSO) unit. The vessel 2 comprises a hull 16 having near a bottom 17 a moon pool 18. A lifting device 26 is placed on the turret mooring structure 3 comprising a cable 19, shown in FIGS. 1*a*-*b* and 2, that extends through a central shaft 24 provided in the mooring buoy 6. In addition, the vessel 2 comprises a turret mooring system 1, wherein the turret mooring system 1 is rotatably suspended from the hull 16 of the vessel 2. The turret mooring system 1 comprises a turret mooring structure 3 within the moon pool 18.

A turret bearing system 21 connects and aligns the turret mooring structure 3 with respect the vessel 2. The turret mooring system 1 is as a whole rotationally suspended from the vessel 2. The turret mooring system 1 can rotate with respect to the vessel 2 to allow the vessel 2 to weathervane after connection to the mooring buoy 6 or to orientate the turret mooring system 1 with respect to the mooring buoy 6, without the need to reposition the vessel 2.

In addition, the turret mooring system 1 may comprise an intermediate connection member 4. Such an intermediate connection member 4 is arranged to be rotated together with the mooring buoy 6 with respect to the turret mooring structure 3, i.e. after locking the mooring buoy 6 inside the cavity 5, so that the fluid piping of the turret manifold piping and the buoy manifold piping can be aligned. The intermediate connection member 4 is positioned in between the turret mooring structure 3 and the mooring buoy 6, if present. After disconnecting the mooring buoy 6, the intermediate connection member 4 remains attached to the turret mooring structure 3.

The turret mooring structure 3 comprises a cavity 5 for receiving the mooring buoy 6. In an alternative embodiment (not shown), the cavity 5 could be attached directly to the intermediate connection member 4, if present. The mooring buoy 6 carries an anchoring system 27 which may comprise at least 1 anchoring leg 22 that is connected to a seabed 23. The mooring buoy 6 is receivable in the cavity 5 for coupling with the turret mooring structure 3.

The turret mooring structure 3 comprises a buoy locking system 7, comprising a number of buoy locking devices 10, that may be circumferentially distributed around the cavity, for locking the mooring buoy 6 inside the cavity 5. An embodiment of the buoy locking device 10 is described with reference to FIGS. 2-7. The buoy locking system 7 is only shown schematically in FIGS. 1*a-b*.

The turret mooring structure 3 comprises a turret manifold 8 that can be connected, after alignment, to a corresponding buoy manifold 9 to establish a fluid flow path between the turret mooring structure 3 and the mooring buoy 6.

When the mooring buoy 6 enters the cavity 5, the mooring buoy 6 is pre-centered into the cavity 5, due to its conical shape and fenders 11 on the inside of the cavity 5, and due to the pulling tension in the reconnection winch cable of the lifting device 26. The fenders 11 only serve to maintain a predetermined radial position of the buoy from the cavity wall and in no way impair up and down movement of the buoy 6 inside the cavity 5. At the top side of the buoy 6 a gap with a width D of is maintained between the buoy and the cavity wall, which may amount to one or a few mm. Substantially no vertically upward forces are transferred from the buoy to the cavity for parts of the buoy that are situated above the buoy locking devices 10.

When approaching the locking devices 10, the upper ring portion 200 of the buoy, lifted-up by a winch, comes into contact with the locking devices 10. When centering is completed, the locking devices are closed and clamp the upper ring portion 200 of the buoy in the turret mooring structure 3.

After alignment of the fluid piping manifolds and the locking of the turret with regard to the connected buoy 6, a fluid transfer path can be established between the turret and buoy manifold.

Figure 2:
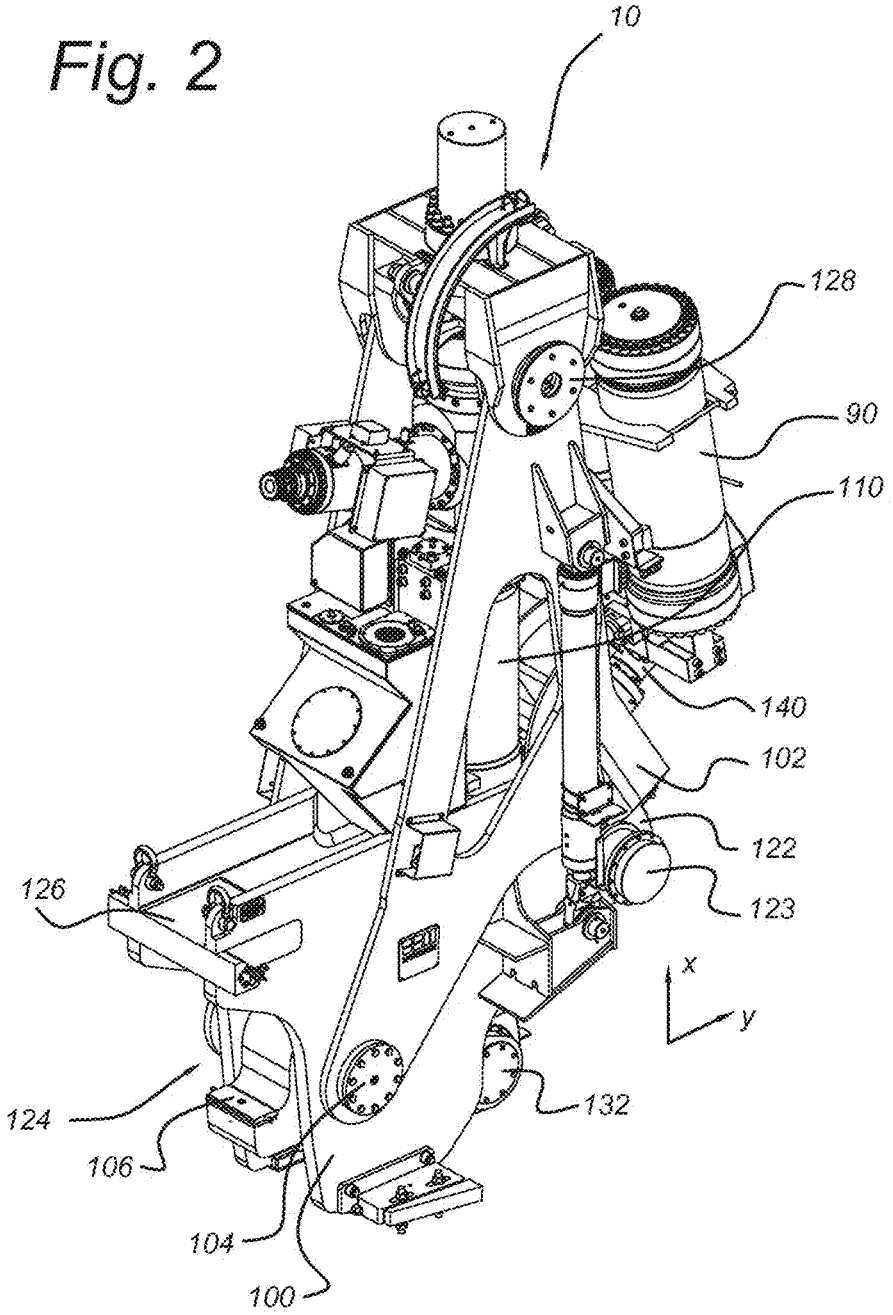
FIG. 2 shows a perspective view of an embodiment of a locking device according to the present invention.

FIG. 2 shows a perspective view of an embodiment of a locking device according to the present invention.

The locking device 10 comprises a first support frame 100 and a second support frame 102. Further the locking device 10 comprises a locking dog 106 that is actuated by a main hydraulic jack 110.

In this embodiment, the first support frame 100 is substantially T-shaped and connected to the turret mooring structure by fixed bottom and side supports 120 and 122 which are located at two substantially perpendicular ends of the T-shaped first support frame. The connection between the first support frame 100 and the fixed supports may be by shafts 121 and 123 respectively.

The second support frame 102 is a substantially oblong frame which has a first end that is rotatably connected to the first support frame by a common shaft 104, which is located in the first support frame at some vertical distance above the fixed bottom support 120.

The locking dog 106 is rotatably connected to the first support frame 100 on the common shaft 104. The centering dog 108 is connected to the first support frame 100 on a dedicated shaft 125 which is located at a vertical distance above the common shaft.

The locking dog 106 is arranged on a free end 124 of the first support frame 100, i.e., the end of the first support frame that is not connected to the fixed bottom or side supports 120, 122.

A second end of the second support frame 102 is rotatably connected to one end of the main hydraulic jack 110 by means of a shaft 128.

The opposite end of the hydraulic jack 110 is rotatably connected to the locking dog 106 through a hinge 132. The arrangement of the hydraulic jack and the locking dog is described in more detail with reference to FIG. 3. A hydraulic power unit (HPU) 90 is mounted on the hydraulic jack 110, so as to be pivotable together with the jack, as can be clearly seen in FIG. 3.

Additionally, the locking device comprises on the second support frame 102 a backup release (hydraulic) jack 140, which provides a releasable connection between the second support frame and the first support frame at a location adjacent to the fixed side support 122.

One or more of shafts 104, 121, 122, 125, 128 of the locking device 10 are preferably provided with low friction bushes.

The hydraulic jack on each individual locking device can be operated by a dedicated HPU, with the HPU being integrated within the locking device structure (i.e. mounted onto the jack and fluid connected to the cylinder via a rigid duct instead of fluid connection over a distance via a flexible duct). This has the advantage of having a standalone locking device forming a one piece assembly which is complete and only needs to be installed on site.

Figure 3:
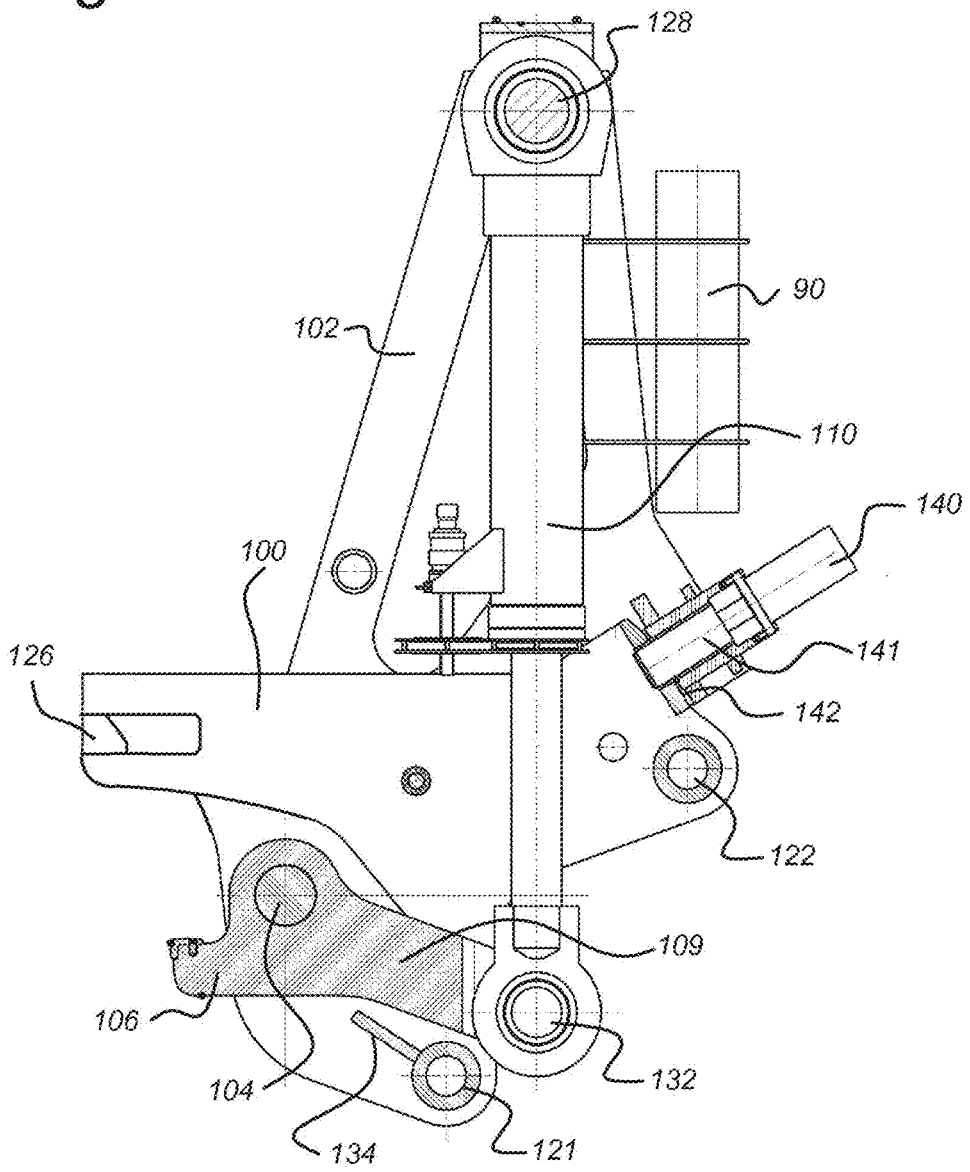
FIG. 3 shows a cross-section of the locking device of FIG. 2.

FIG. 3 shows a cross-section of the locking device of FIG. 2.

Figure 6:
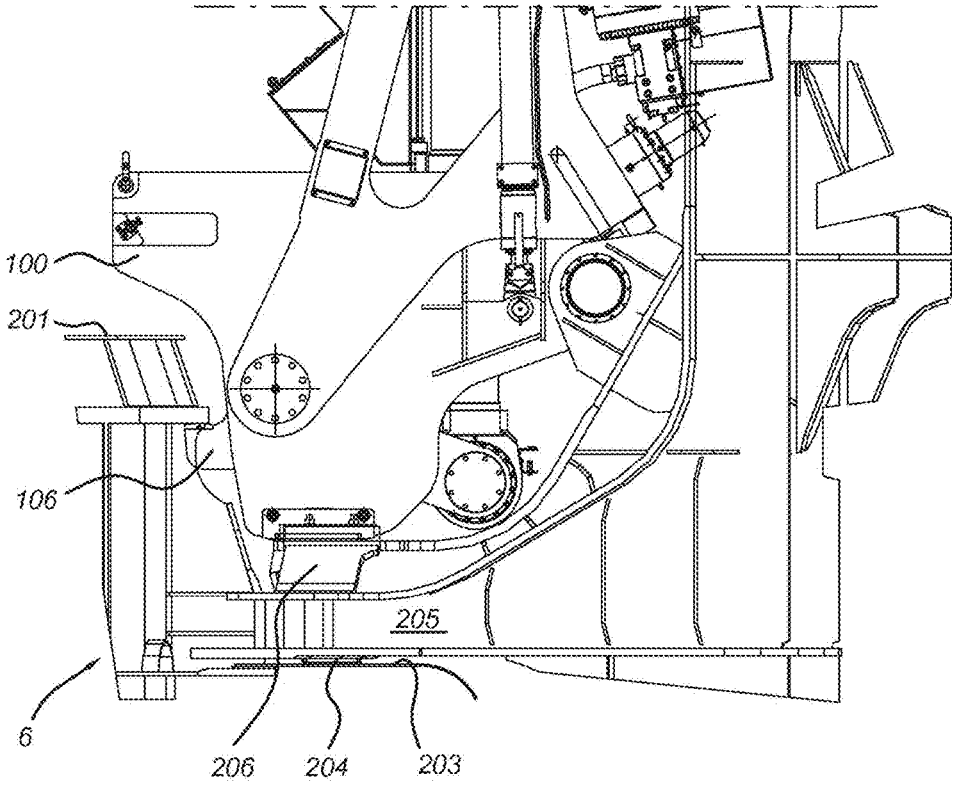
FIG. 6 schematically shows a locking device according to an embodiment of the invention.

The hydraulic jack 110 is rotatably connected to an extension arm 109 of the locking dog 106 through the hinge 132, such that a change of the length of the hydraulic jack causes a rotation of the locking dog 106 around common shaft 104. In FIG. 3, the hydraulic jack is shown in its extended position, with the locking dog 106 in a clamping position of the mooring buoy (not shown). In this clamping position, the buoy is clamped in a vertical direction by the locking dog 106 against the lower engagement member 107 (see FIG. 4*c*; FIG. 6) or 108 (see FIG. 5*b*) or on the turret without the top surface 201 of the buoy abutting against the support frame 100 or any other parts of the cavity wall such that a preloading of the buoy against the relatively elastic lower engagement member is effected and peak loads are prevented from acting on the locking dog 6.

The backup release jack 140 is shown in FIG. 3 in the connected position having a release pin 141 attached to the second support frame and positioned in a locking hole 142 attached to the first support frame to form a releasable connection 141, 142. The backup release jack is arranged as a releasable lock that can break the releasable connection in case of a malfunction of the locking device (or an emergency) during the clamping position. By releasing the releasable connection the second support frame 102 can rotate with respect to the first support frame around the common shaft. Since the rotation axis (common shaft) of the second support frame coincides with the rotation axis 104 of the locking dog 106, the locking dog will rotate accordingly to an open position so as to release the buoy.

Figure 4A:
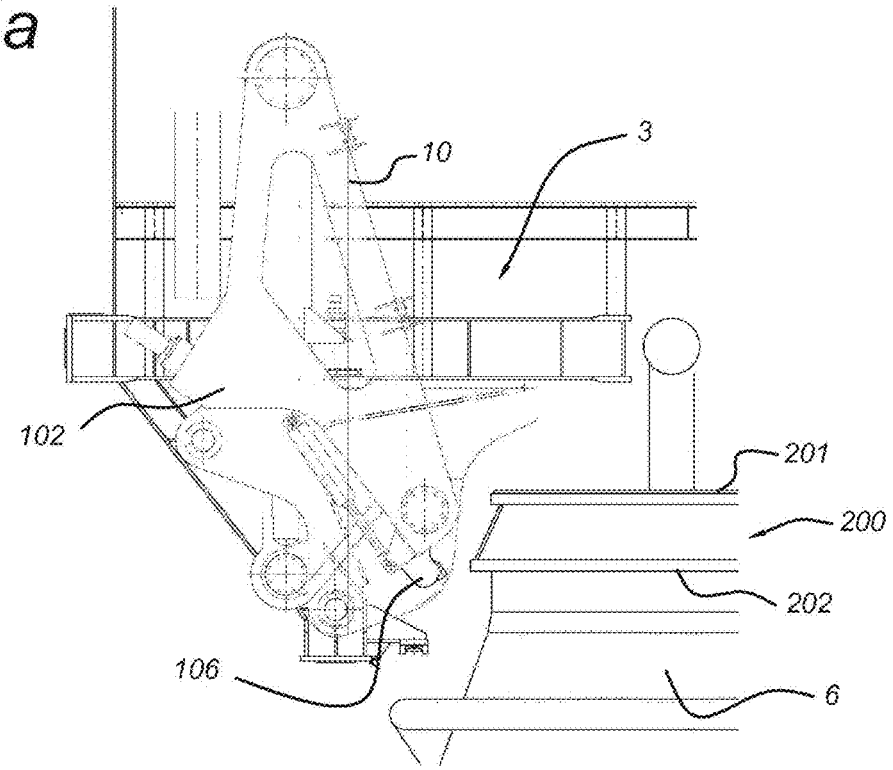
FIG. 4*a* schematically shows the locking device during a first stage of positioning of the buoy into the turret.

In FIG. 4*a* schematically the locking device 10 is shown during a first stage of positioning of the buoy 6 into the turret mooring structure 3.

The mooring buoy 6 comprises a top ring portion 200 which has an upper edge or surface 201 and a lower edge 202.

Figure 4B:
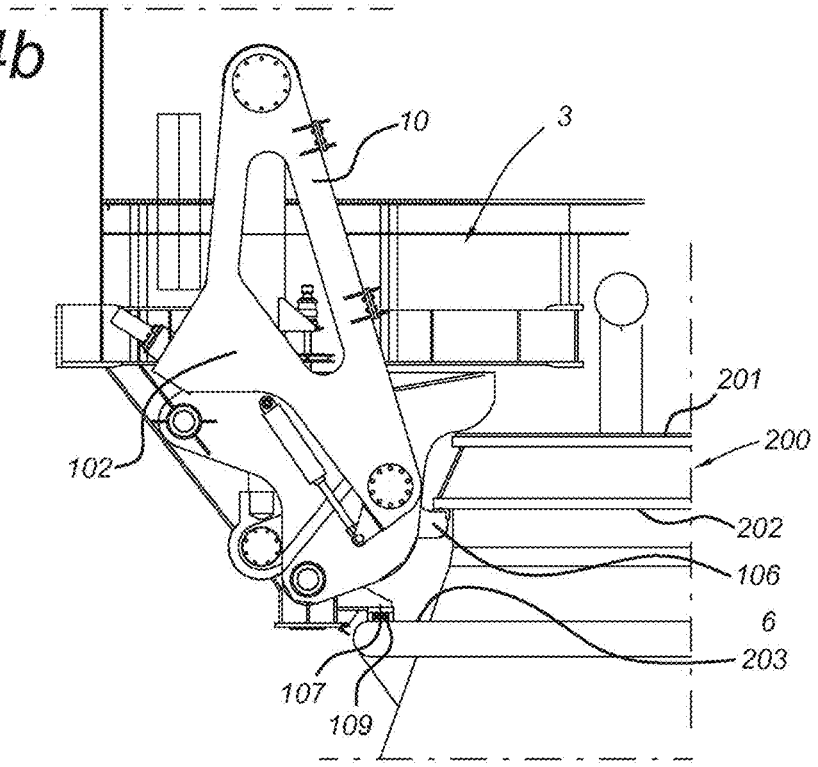
FIG. 4*b* schematically shows the locking device during a last stage of positioning of the buoy into the turret.

FIG. 4*b* schematically shows the locking device during connection of the buoy 6 into the cavity 5 of the turret in accordance with an embodiment of the invention.

In this embodiment, the mooring buoy 6 comprises a ring portion 200 at a top part of the buoy that is received in the turret. The ring portion is provided with a first abutment surface 202 and a second abutment surface 203 placed at a distance from and in parallel with the first abutment surface.

The buoy locking system 7 comprises at least one locking device 10 that in a first support frame 100 comprises a rotatable locking dog 106 and a lower engagement element 107. Within the locking device 10 the locking dog 106 and the lower engagement element 107 are positioned at a vertical distance from each other.

The rotatable locking dog 106 is arranged for engagement with the upper abutment surface 202 provided on the ring portion 200 of the mooring buoy 6. The upper abutment surface is collar shaped and positioned in an upper region of the ring portion. Thus a contacting surface of the locking dog can engage the first abutment surface by moving upwards.

The lower abutment surface 203 is arranged below the upper abutment surface 202. The engagement element 107 of the locking device can be passive and can engage with the lower abutment surface 203 of the mooring buoy 6, the upward movement of the locking dog effectively pulling the lower abutment surface 203 up to a contacting surface of the engagement element 107. An annular sealing element 109 may be attached to the engagement element 107 for preventing of water ingress along the engagement element. The engagement element 107 may be embodied as a fixed bumper.

Figure 5A:
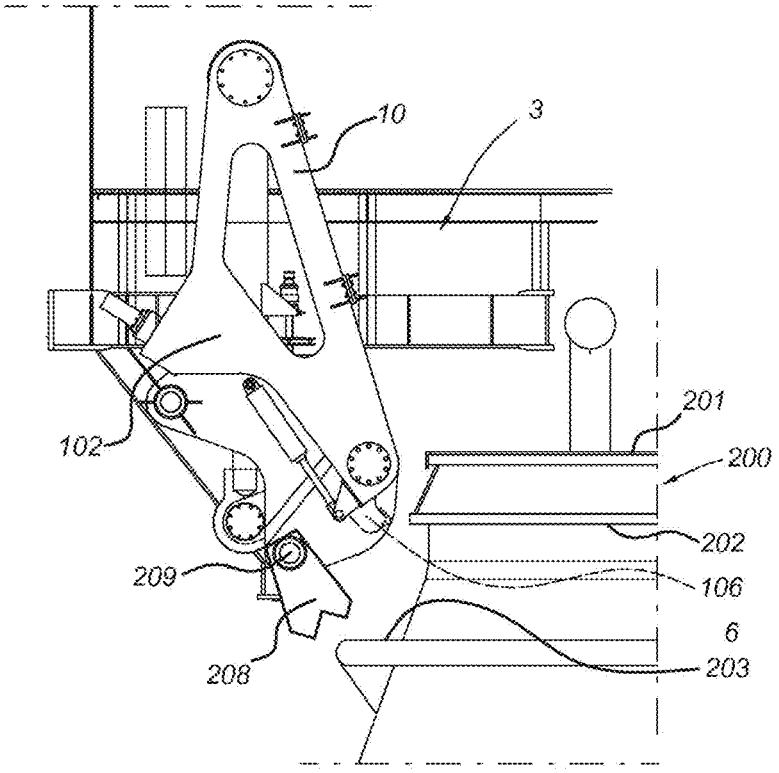
FIGS. 5*a* and 5*b* schematically show a locking device in accordance with an embodiment of the invention.
Figure 5B:
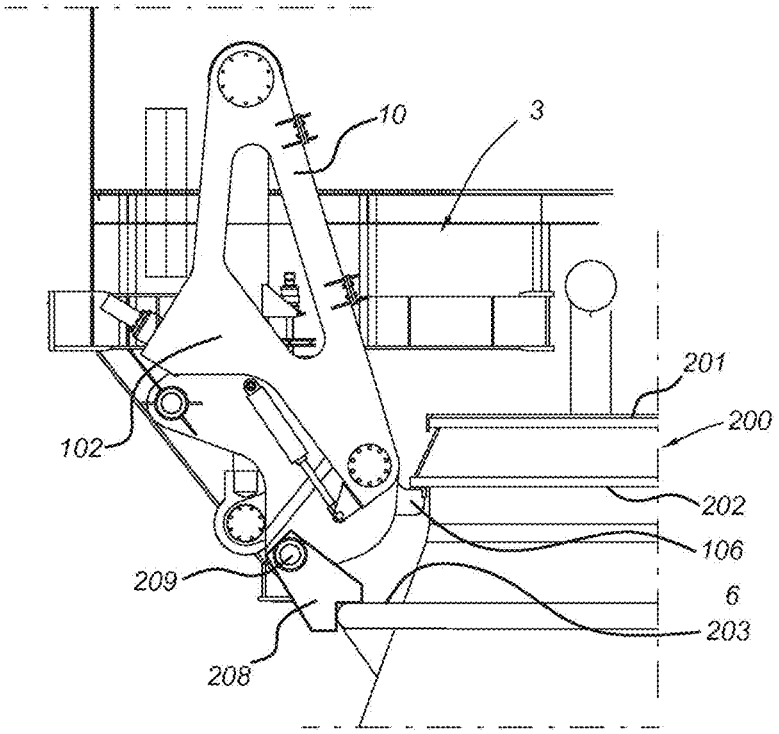

In the embodiment shown in FIG. 5*a*, the mooring buoy 6 comprises a ring portion 200 at a top part of the buoy that is received in the turret. The ring portion is provided with a first abutment surface 203 and a second abutment surface 203 placed at a distance from and in parallel with the first abutment surface.

The buoy locking system 7 comprises at least one locking device 10 that in a first support frame 100 comprises a rotatable upper locking dog 106 and a lower centering dog element 208. Within the locking device 10 the locking dog 106 and a lower centering dog 208 are positioned at a vertical distance from each other. The lower centering dog 208 is arranged for rotation around a horizontal axis 209 between a lower position and an upper position. In the upper position the lower centering dog 208 is configured to be blocked from further upward rotation around the axis 209.

The rotatable locking dog 106 is arranged for engagement with the first abutment surface 202 provided on the ring portion 200 of the mooring buoy 6. The first abutment surface is collar shaped and positioned in an upper region of the ring portion. Thus a contacting surface of the locking dog 106 can engage the first abutment surface by moving upwards.

Before contacting the second abutment surface 203 of the buoy 6, the lower centering dog 208 is in a freely pivoting open position, configured to contact and engage with the second abutment surface 203 and after contact to be rotated upward with the upward moving buoy 6.

During the upward movement of the second abutment surface 203, the lower centering dog 208 rotates upwards, until the upper position is reached and further rotation is blocked. In that upper position the upward movement of the buoy surface is stopped.

The upward movement of the locking dog 106 may enlarge the distance between the locking dog and the lower centering dog 208, thus effectively pulling the second abutment surface up to a contacting surface of the lower centering dog 208. In this manner the buoy is clamped to the locking device 10.

In the clamped position a distance between the contacting surface of the rotatable locking dog 106 and the contacting surface of the lower centering dog 208 corresponds substantially with the distance between the second abutment surface 203 and the first abutment surface 202 on the mooring buoy.

The contacting surfaces of the locking device may exert adequate forces on the first and second abutment surfaces 202, 203 to generate a clamping force for holding the mooring buoy 6 in position.

FIG. 6 schematically shows a locking device in accordance with an embodiment of the invention.

In this embodiment, the buoy locking system 7 comprises at least one locking device 10, with first support frame 100 that is connected to the turret mooring structure 205 via a support member 206 and which comprises the rotatable locking dog 106. The buoy 6 has an annular abutment surface 203 that is, via a flexible annular seal 204, pulled against the turret structure 205 by upward movement of the locking dog 106.

The invention claimed is:

1. A mooring assembly, comprising:

a mooring buoy (6) comprising a central axis, and an upper ring portion (200) providing an upper abutment surface (202);

a mooring structure (3) comprising a cavity (5) with a cavity wall arranged for receiving the mooring buoy (6); and a buoy locking system (7) located at the cavity (5) for engaging with the upper ring portion (200) for locking the mooring buoy (6) to the turret mooring structure (6), and comprising at least two locking devices (10) attached to the mooring structure (3), each locking device (10) having a locking dog (106) connected to a force member (110) for upward axial displacement and exertion of an upward force on the upper abutment surface (202), wherein:

the mooring buoy (6) further comprises an annular lower abutment rim (203) located at an axial distance below the upper abutment surface (202) and protruding radially from a surface of the buoy parallel with the upper ring portion, the buoy locking system (7) further comprises an engagement member (107,208) situated axially below the locking dog (106) extending radially inward from the cavity wall and configured for engaging with a top part of the lower abutment rim (203) and for exerting a downward force thereon, and a top of the mooring buoy being at a position (201) axially above the upper abutment surface (202) having an axial clearance (D) from the cavity wall when engaged with the buoy locking system, such that axial forces on the buoy are transferred to the turret mooring structure (6) substantially only at the positions of the locking dog (106) and the engagement member (107,208).

2. The mooring assembly according to claim 1, wherein the locking dog (106) is rotatable around a horizontal shaft (104), the force member comprising an axially movable hydraulic jack (110).

3. The mooring assembly according to claim 2, a hydraulic power unit being mounted on the hydraulic jack (110) for supplying high pressure fluid to the hydraulic jack and for following pivoting movements of the hydraulic jack.

4. A locking device (10) for use in a buoy locking system, comprising:

a frame with a pivotable locking dog (106) and with a hydraulic jack (110) attached to the frame and to the locking dog (110) for pivoting the locking dog; and a hydraulic power unit being mounted on the hydraulic jack (110) for supplying high pressure fluid to the hydraulic jack and for following pivoting movements of the hydraulic jack.

5. A structure having a mooring system and a buoy locking system according to claim 1.

6. A vessel having a mooring system and a buoy locking system according to claim 1.

7. A hydrocarbon production system comprising a vessel according to claim 6.

8. A structure having a mooring system and a buoy locking system according to claim 2.

9. A structure having a mooring system and a buoy locking system according to claim 3.

10. A structure having a mooring system and a buoy locking device according to claim 4.

11. A vessel having a mooring system and a buoy locking system according to claim 2.

12. A vessel having a mooring system and a buoy locking system according to claim 3.

* * * * *